US011927199B2

(12) United States Patent
Nakaniwa et al.

(10) Patent No.: US 11,927,199 B2
(45) Date of Patent: Mar. 12, 2024

(54) COMPRESSOR

(71) Applicant: MITSUBISHI HEAVY INDUSTRIES COMPRESSOR CORPORATION, Tokyo (JP)

(72) Inventors: Akihiro Nakaniwa, Tokyo (JP); Koji Maeta, Tokyo (JP); Takashi Oda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/703,579

(22) Filed: Mar. 24, 2022

(65) Prior Publication Data

US 2022/0349423 A1 Nov. 3, 2022

(30) Foreign Application Priority Data

Apr. 28, 2021 (JP) ..... 2021-075987

(51) Int. Cl.
*F04D 29/66* (2006.01)
*F04D 17/10* (2006.01)

(52) U.S. Cl.
CPC ..... *F04D 29/663* (2013.01); *F04D 17/10* (2013.01)

(58) Field of Classification Search
CPC ..... F04D 29/663; F04D 29/664
See application file for complete search history.

(56) References Cited

U.S. PATENT DOCUMENTS 6,669,436 B2 * 12/2003 Liu ..... F04D 29/444 415/119
9,728,177 B2 * 8/2017 Mekid ..... G10K 11/002
2002/0079158 A1 6/2002 Liu
2020/0096007 A1 * 3/2020 Takei ..... G10K 11/16

* cited by examiner

*Primary Examiner* — Sabbir Hasan

(57) ABSTRACT

A compressor includes a rotation shaft which rotates around an axis, an impeller which press-feeds a fluid from one side in an axial direction toward an outward side in a radial direction by rotating together with the rotation shaft, a casing which surrounds the rotation shaft and the impeller and in which an exit flow channel for introducing a fluid press-fed from the impeller is formed, and an acoustic liner which is provided so as to face the inside of the exit flow channel in the casing. The acoustic liner has a plurality of open hole portions which are arranged with intervals therebetween, and acoustic spaces which communicate with the open hole portions and are independently provided for the respective open hole portions.

18 Claims, 3 Drawing Sheets

COMPRESSOR

BACKGROUND OF THE INVENTION

Field of the Invention

The present disclosure relates to a compressor.

Priority is claimed on Japanese Patent Application No. 2021-075987, filed on Apr. 28, 2021, the content of which is incorporated herein by reference.

Description of Related Art

In turbo machines including a compressor, noise is generated in accordance with rotation of rotating components. If such noise is propagated to stationary components, there is concern that structural breakdown of the stationary components may be caused. Hence, for the purpose of preventing noise, a constitution in which an acoustic liner is provided in an exit flow channel of a compressor has been proposed (United States Patent Application, Publication No. 2002/0079158). This acoustic liner has introduction holes opening toward the exit flow channel, and acoustic spaces connected to a downstream side of the introduction holes. A plurality of introduction holes are formed with respect to one acoustic space.

SUMMARY OF THE INVENTION

Incidentally, in an exit flow channel of a compressor, a static pressure increases toward a downstream side. For this reason, in an acoustic liner, a leakage flow is generated toward acoustic holes on an upstream side via acoustic spaces from introduction holes positioned on a relatively downstream side. As a result, there is concern that a fluid may not appropriately flow into the acoustic spaces and the characteristics of the acoustic liner may be affected.

The present disclosure has been made in order to resolve the foregoing problems, and an object thereof is to provide a compressor in which noise is further reduced.

A compressor according to the present disclosure includes a rotation shaft which rotates around an axis, an impeller which press-feeds a fluid from one side in an axial direction toward an outward side in a radial direction by rotating together with the rotation shaft, a casing which surrounds the rotation shaft and the impeller and in which an exit flow channel for introducing a fluid press-fed from the impeller is formed, and an acoustic liner which is provided so as to face the inside of the exit flow channel in the casing. The acoustic liner has a plurality of open hole portions which are arranged with intervals therebetween, and acoustic spaces which communicate with the open hole portions and are independently provided for the respective open hole portions.

According to the present disclosure, it is possible to provide a compressor in which noise is further reduced.

DETAILED DESCRIPTION OF THE INVENTION

First Embodiment (Constitution of Compressor)

Figure 1:
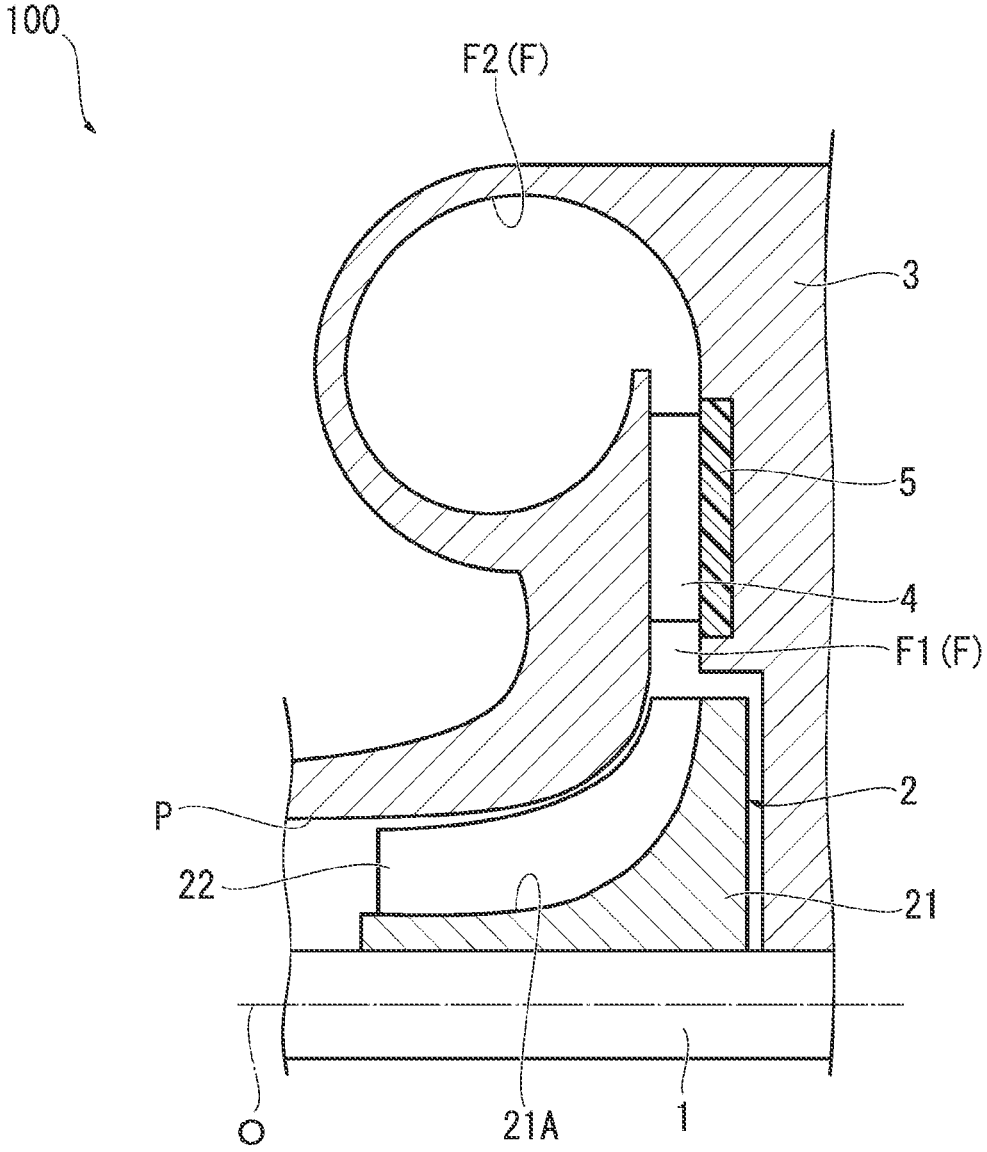
FIG. 1 is a longitudinal cross-sectional view showing a constitution of a compressor according to a first embodiment of the present disclosure.
Figure 2:
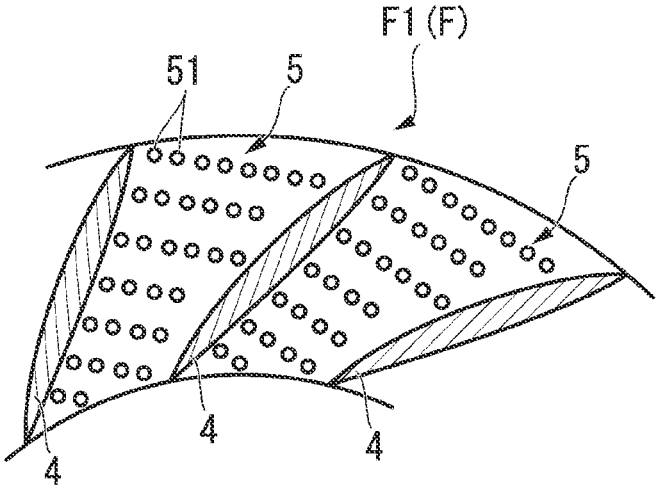
FIG. 2 is a plan view showing a constitution of an exit flow channel of the compressor according to the first embodiment of the present disclosure.

Hereinafter, a compressor 100 according to a first embodiment of the present disclosure will be described with reference to FIGS. 1 to 3. As shown in FIG. 1, the compressor 100 includes a rotation shaft 1, an impeller 2, a casing 3, diffuser vanes 4, and an acoustic liner 5.

The rotation shaft 1 extends along an axis O and can rotate around the axis O. The impeller 2 is fixed to an outer circumferential surface of the rotation shaft 1. The impeller 2 has a disk 21 and a plurality of blades 22. The disk 21 has a disk shape centering on the axis O. An outer circumferential surface (main surface 21A) of the disk 21 has a curved surface shape curved from an inward side toward an outward side in a radial direction from one side toward the other side in an axis O direction.

On this main surface 21A, the plurality of blades 22 are provided at intervals in a circumferential direction. Although it is not specifically shown, each of the blades 22 is curved from a front side toward a rear side in a rotation direction of the rotation shaft 1 from the inward side toward the outward side in the radial direction. The impeller 2 press-feeds a fluid introduced from one side in the axis O direction toward the outward side in the radial direction by rotating together with the rotation shaft 1.

The casing 3 surrounds the rotation shaft 1 and the impeller 2 from an outer circumferential side. A compression flow channel P and an exit flow channel F are formed inside the casing 3. The compression flow channel P accommodates the impeller 2 and compresses a fluid introduced from the outside. The exit flow channel F is connected to the outward side of the compression flow channel P in the radial direction are formed. The compression flow channel P gradually increases in diameter from one side toward the other side in the axis O direction so as to correspond to the external shape of the impeller 2. The exit flow channel F is connected to an exit of the compression flow channel P on the outward side in the radial direction.

The exit flow channel F has a diffuser flow channel F1 and an exit scroll F2. The diffuser flow channel F1 is provided so as to recover a static pressure of a fluid introduced from the compression flow channel P. The diffuser flow channel F1 has a ring shape extending from the exit of the compression flow channel P toward the outward side in the radial direction. In a cross-sectional view including the axis O, a flow channel width of the diffuser flow channel F1 is constant throughout the entire region in an extending direction. A plurality of diffuser vanes 4 are provided in the diffuser flow channel F1. As shown in FIG. 2, the plurality of diffuser vanes 4 are arranged at intervals in the circumferential direction. In addition, each of the diffuser vanes 4 extends toward the front side of the impeller 2 in the rotation direction from the inward side toward the outward side in the radial direction with respect to the axis O. Namely, the diffuser vanes 4 are inclined with respect to the radial direction with respect to the axis O.

As shown in FIG. 1, the exit scroll F2 is connected to an exit of the diffuser flow channel F1 on the outward side in the radial direction. The exit scroll F2 has a spiral shape extending in the circumferential direction of the axis O. The exit scroll F2 has a circular flow channel cross section. Discharge holes (not shown) for introducing a high-pressure fluid to the outside are formed in a portion of the exit scroll F2.

(Constitution of Acoustic Liner)

The acoustic liner 5 is provided on a wall surface on the other side in the axis O direction in the diffuser flow channel F1 described above. The acoustic liner 5 is provided so as to absorb and attenuate noise due to a fluid flowing in the diffuser flow channel F1. The acoustic liner 5 is buried inside this wall surface so as to face the diffuser flow channel F1. More specifically, in the present embodiment, the acoustic liner 5 is provided on a surface facing one side in the axis O direction in the diffuser flow channel F1. The acoustic liner 5 may also be provided on a surface facing the other side in the axis O direction in the diffuser flow channel F1. In addition, a constitution in which the acoustic liner 5 is provided on only the surface facing the other side in the axis O direction can also be employed. The acoustic liner 5 has a ring shape centering on the axis O.

Figure 3:
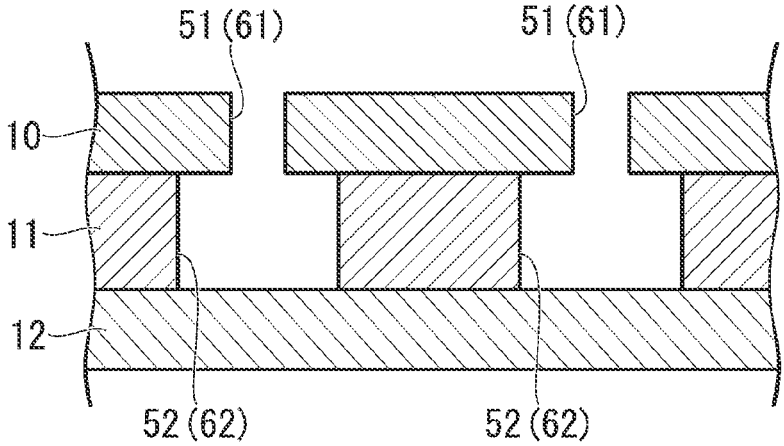
FIG. 3 is a cross-sectional view showing a constitution of an acoustic liner according to the first embodiment of the present disclosure.

As shown in FIG. 3, the acoustic liner 5 has a plurality of open hole portions 51 and a plurality of acoustic spaces 52. The open hole portions 51 are arranged with intervals therebetween along the wall surface of the diffuser flow channel F1. In addition, the open hole portions 51 are formed on the wall surface with a uniform open hole rate (the number of open holes per unit area is constant). The open hole portions 51 communicate with the acoustic spaces 52. The acoustic spaces 52 are independently provided for the respective open hole portions 51. The open hole portions 51 have a smaller radial dimension than the acoustic spaces 52. Accordingly, each of the open hole portions 51 and the acoustic spaces 52 forms a Helmholtz resonator. In addition, as shown in FIG. 2, as an example in the present embodiment, the open hole portions 51 are arranged in a direction orthogonal to the diffuser vanes 4 on the rear side in the rotation direction, and a plurality of such rows are disposed in the radial direction.

As shown in FIG. 3, the acoustic liner 5 is formed by stacking three plate members. Specifically, the acoustic liner 5 has a first plate member 10 in which first hole portions 61 serving as the open hole portions 51 are formed in advance, a second plate member 11 in which second hole portions 62 serving as the acoustic spaces 52 are formed in advance, and a planar third plate member 12 in which no holes are formed. Positions of the first hole portions 61 and the second hole portions 62 coincide with each other. The acoustic liner 5 having the independent acoustic spaces 52 as described above is formed by stacking the first plate member 10, the second plate member 11, and the third plate member 12 in this order. Such an acoustic liner 5 is buried in a recess portion formed on the wall surface of the diffuser flow channel F1. The acoustic liner 5 can also be formed by burying only the first plate member 10 and the second plate member 11 in the recess portion on the wall surface without providing the third plate member 12.

(Operational Effects)

Next, operation of the compressor 100 will be described. When the compressor 100 is operated, first, the rotation shaft 1 is rotated around the axis O by means of an external driving source. The impeller 2 also rotates in accordance with rotation of the rotation shaft 1. Accordingly, an external fluid is introduced into the compression flow channel P. A fluid which has been guided to the blades 22 of the impeller 2 in the compression flow channel P is compressed due to a centrifugal force and is in a high-pressure state. This flow channel in a high-pressure state is drawn out to the outside via the diffuser flow channel F1 and the exit scroll F2.

Here, in the compressor 100 described above, noise is generated in accordance with rotation of the impeller 2. In such noise, particularly noise which is referred to as NZ-noise is likely to cause resonance with each portion of the compressor 100. Therefore, it is important to reduce and curb the noise. NZ-noise is noise at a frequency (discrete frequency sound) based on the integrated value of the number Z of blades (namely, the number of blades 22) of the impeller 2 and the number N of rotations of the rotation shaft 1.

For the purpose of reducing and curbing such NZ-noise, in the present embodiment, the acoustic liner 5 is provided in the diffuser flow channel F1. Sound waves which have been introduced into the acoustic spaces 52 through the open hole portions 51 are attenuated inside the acoustic spaces 52. Accordingly, leakage of noise to the outside can be curbed.

Incidentally, in the diffuser flow channel F1 described above, recovery of the static pressure proceeds toward the outward side in the radial direction. Therefore, the pressure of a fluid becomes high. In addition, also in a direction in which the diffuser vanes 4 are connected to each other (the rotation direction of the impeller 2), the pressure of a fluid becomes high toward the front side in the rotation direction. For this reason, for example, when a single acoustic space 52 is formed with respect to a plurality of open hole portions 51, there is concern that a leakage flow of a fluid may be generated through the acoustic spaces 52 on the basis of imbalance in the foregoing pressure distribution. Namely, a leakage flow from the open hole portions 51 on a high-pressure side toward the open hole portions 51 on a low-pressure side via the acoustic spaces 52 is generated. If such a leakage flow is generated, there is concern that a fluid may not appropriately flow into the acoustic spaces 52 and the characteristics of the acoustic liner 5 may be affected.

Hence, in the present embodiment, as described above, the acoustic spaces 52 which are independent for the respective open hole portions 51 are formed. According to the foregoing constitution, since the acoustic spaces 52 are independently provided for the respective open hole portions 51, it is possible to reduce the likelihood that a leakage flow will be generated from a high-pressure region on a downstream side of the diffuser flow channel F1 toward a low-pressure region on an upstream side via the acoustic spaces 52. As a result, the acoustic characteristics of the acoustic liner 5 can be improved.

In addition, according to the foregoing constitution, the acoustic liner 5 can be constituted easily with high processing accuracy by simply stacking the first plate member 10 in which the first hole portions 61 are formed in advance and the second plate member 11 in which the second hole portions 62 are formed in advance. Accordingly, processing costs and maintenance costs can be curtailed.

Hereinabove, the first embodiment of the present disclosure has been described. The foregoing constitutions can be subjected to various changes and modifications within a range not departing from the gist of the present disclosure. For example, in the foregoing first embodiment, an example in which the open hole portions 51 are formed with a uniform open hole rate throughout the entire region on a surface of the acoustic liner 5 has been described. However, since the foregoing NZ-noise becomes more noticeable in a region on the upstream side closer to the impeller 2, the open hole portions 51 can also be constituted such that the open hole rate thereof becomes smaller toward the downstream side of the diffuser flow channel F1 (namely, the outward side in the radial direction).

Second Embodiment

Figure 4:
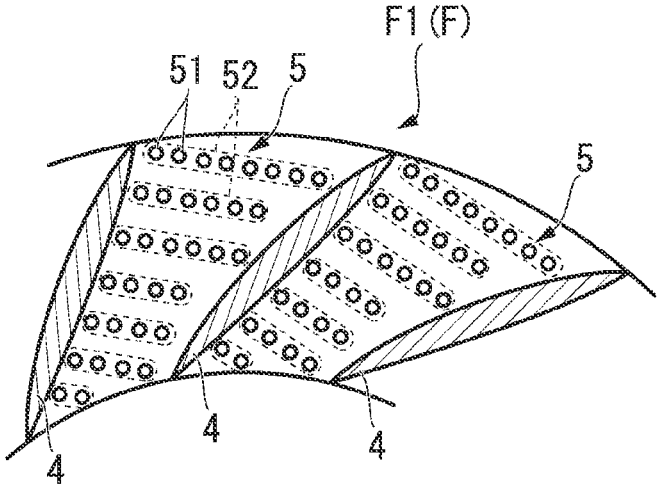
FIG. 4 is a plan view showing a constitution of an acoustic liner according to a second embodiment of the present disclosure.

Next, a second embodiment of the present disclosure will be described with reference to FIG. 4. The same reference signs are applied to constitutions similar to those of the foregoing first embodiment, and detailed description will be omitted. As shown in FIG. 4, in the present embodiment, in regions of which static pressures are equivalent to each other in the exit flow channel F (diffuser flow channel F1), the acoustic spaces 52 communicate with each other. More specifically, in regions extending in a direction orthogonal to suction surfaces (surfaces facing the front side of the impeller 2 in the rotation direction) of the diffuser vanes 4, the acoustic spaces 52 communicate with each other. The aforementioned term "orthogonal" indicates a practically orthogonal state, and architectural tolerance or a manufacturing error is allowed.

Here, in regions of which static pressures are equivalent to each other in the diffuser flow channel F1, a leakage flow via the acoustic spaces 52 is unlikely to be generated. For this reason, large volumes of the acoustic spaces 52 can be secured by causing the acoustic spaces 52 to communicate with each other for each of the regions. Accordingly, the acoustic characteristics of the acoustic liner can be further improved.

As a specific example, the static pressure is constant in regions extending in a direction orthogonal to the diffuser vanes 4, and a leakage flow via the acoustic spaces is unlikely to be generated. For this reason, large volumes of the acoustic spaces 52 can be secured by employing the constitution described above. Accordingly, the acoustic characteristics of the acoustic liner can be further improved.

Figure 5:
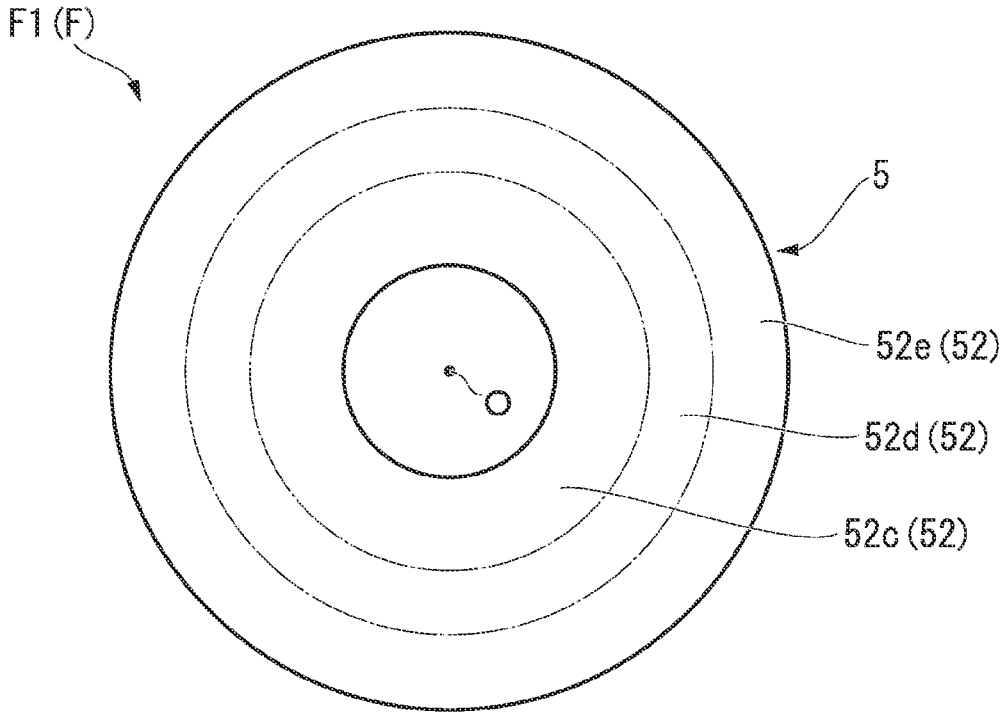
FIG. 5 is a plan view showing a modification example of the acoustic liner according to the second embodiment of the present disclosure.

Hereinabove, the second embodiment of the present disclosure has been described. The foregoing constitutions can be subjected to various changes and modifications within a range not departing from the gist of the present disclosure. For example, when a constitution in which the compressor 100 is provided with no diffuser vanes 4 is employed, as shown in FIG. 5, it is possible to employ a constitution in which the acoustic spaces 52 of the acoustic liner 5 are divided into a plurality of (as an example, three) ring regions 52*c*, 52*d*, and 52*e* arranged in the radial direction centering on the axis O and the acoustic spaces 52 are caused to communicate with each other for each of the regions.

According to the foregoing constitution, in a compressor provided with no diffuser vanes 4, the static pressure becomes constant in ring regions extending in the circumferential direction in the exit flow channel F. For this reason, a leakage flow via the acoustic spaces 52 is unlikely to be generated in the regions. For this reason, large volumes of the acoustic spaces 52 can be secured by causing the acoustic spaces 52 to communicate with each other. Accordingly, the acoustic characteristics of the acoustic liner 5 can be further improved.

APPENDIX

The compressor 100 described in each of the embodiments is ascertained as follows, for example.

(1) A compressor 100 according to a first aspect includes a rotation shaft which rotates around an axis, an impeller which press-feeds a fluid from one side in an axial direction toward an outward side in a radial direction by rotating together with the rotation shaft, a casing which surrounds the rotation shaft and the impeller and in which an exit flow channel for introducing a fluid press-fed from the impeller is formed, and an acoustic liner which is provided so as to face the inside of the exit flow channel in the casing. The acoustic liner has a plurality of open hole portions which are arranged with intervals therebetween, and acoustic spaces which communicate with the open hole portions and are independently provided for the respective open hole portions.

According to the foregoing constitution, since the acoustic spaces are independently provided for the respective open hole portions, it is possible to reduce the likelihood that a leakage flow will be generated from a high-pressure region on a downstream side of the exit flow channel toward a low-pressure region on an upstream side via the acoustic spaces. As a result, the acoustic characteristics of the acoustic liner can be improved.

(2) In the compressor 100 according to a second aspect, the acoustic spaces communicate with each other in regions of which static pressures are equivalent to each other in the exit flow channel.

According to the foregoing constitution, in regions of which static pressures are equivalent to each other in the exit flow channel, a leakage flow via the acoustic spaces is unlikely to be generated. For this reason, large volumes of the acoustic spaces can be secured by causing the acoustic spaces to communicate with each other. Accordingly, the acoustic characteristics of the acoustic liner can be further improved.

(3) The compressor 100 according to a third aspect further includes a plurality of diffuser vanes which are provided in the exit flow channel, extend toward a front side of the impeller in a rotation direction from an inward side toward the outward side in the radial direction with respect to the axis, and are arranged at intervals in a circumferential direction. The acoustic spaces communicate with each other in regions extending in a direction orthogonal to the diffuser vanes.

According to the foregoing constitution, the static pressure is constant in regions extending in a direction orthogonal to the diffuser vanes, and a leakage flow via the acoustic spaces is unlikely to be generated. For this reason, large volumes of the acoustic spaces can be secured by causing the acoustic spaces to communicate with each other. Accordingly, the acoustic characteristics of the acoustic liner can be further improved.

(4) In the compressor 100 according to a fourth aspect, the acoustic spaces communicate with each other in regions having ring shapes centering on the axis in the exit flow channel and arranged in the radial direction.

According to the foregoing constitution, in a compressor provided with no diffuser vanes, the static pressure becomes constant in ring regions extending in the circumferential direction in the exit flow channel. For this reason, a leakage flow via the acoustic spaces is unlikely to be generated in the regions. For this reason, large volumes of the acoustic spaces can be secured by causing the acoustic spaces to communicate with each other. Accordingly, the acoustic characteristics of the acoustic liner can be further improved.

(5) In the compressor 100 according to a fifth aspect, the acoustic liner has a first plate member in which first hole portions serving as the open hole portions are formed, and a second plate member which is stacked on the first plate member and in which second hole portions serving as the acoustic spaces are formed at positions corresponding to the open hole portions.

According to the foregoing constitution, the acoustic liner can be constituted easily with high processing accuracy by simply stacking the first plate member in which the first hole portions are formed and the second plate member in which the second hole portions are formed in advance. Accordingly, processing costs and maintenance costs can be curtailed.

EXPLANATION OF REFERENCES

100 Compressor
1 Rotation shaft
2 Impeller
3 Casing
4 Diffuser vane
5 Acoustic liner
10 First plate member
11 Second plate member
12 Third plate member
21 Disk
21A Main surface
22 Blade
51 Open hole portion
52 Acoustic space
61 First hole portion
62 Second hole portion
O Axis
F Exit flow channel
F1 Diffuser flow channel
F2 Exit scroll

What is claimed is:

1. A compressor comprising:
a rotation shaft which rotates around an axis;
an impeller which press-feeds a fluid from one side in an axial direction toward an outward side in a radial direction by rotating together with the rotation shaft;
a casing which surrounds the rotation shaft and the impeller and in which an exit flow channel for introducing the fluid press-fed from the impeller is formed; and
an acoustic liner which is provided so as to face an inside of the exit flow channel in the casing, wherein
the acoustic liner has:
a plurality of open hole portions which are arranged with intervals therebetween; and
a plurality of acoustic spaces, and
each of the acoustic spaces communicates with only one of the open hole portions.

2. The compressor according to claim 1, wherein the acoustic spaces communicate with each other in regions of which static pressures are equivalent to each other in the exit flow channel.

3. The compressor according to claim 2 further comprising:
a plurality of diffuser vanes which are provided in the exit flow channel, extend toward a front side of the impeller in a rotation direction from an inward side toward the outward side in the radial direction with respect to the axis, and are arranged at intervals in a circumferential direction, wherein
the acoustic spaces communicate with each other in regions extending in a direction orthogonal to the diffuser vanes.

4. The compressor according to claim 2, wherein
the acoustic liner further comprises regions having ring shapes centering on the axis extending in a circumferential direction and arranged in the radial direction, and
adjacent ones of the acoustic spaces that are adjacent in each of the regions communicate with each other.

5. The compressor according to claim 1, wherein
the acoustic liner has
a first plate member in which first hole portions serving as the open hole portions are formed, and
a second plate member which is stacked on the first plate member and in which second hole portions serving as the acoustic spaces are formed at positions corresponding to the open hole portions.

6. The compressor according to claim 2, wherein
the acoustic liner has
a first plate member in which first hole portions serving as the open hole portions are formed, and
a second plate member which is stacked on the first plate member and in which second hole portions serving as the acoustic spaces are formed at positions corresponding to the open hole portions.

7. The compressor according to claim 3, wherein
the acoustic liner has
a first plate member in which first hole portions serving as the open hole portions are formed, and
a second plate member which is stacked on the first plate member and in which second hole portions serving as the acoustic spaces are formed at positions corresponding to the open hole portions.

8. The compressor according to claim 4, wherein
the acoustic liner has
a first plate member in which first hole portions serving as the open hole portions are formed, and
a second plate member which is stacked on the first plate member and in which second hole portions serving as the acoustic spaces are formed at positions corresponding to the open hole portions.

9. The compressor according to claim 1, wherein the open hole portions are constituted such that a number of the open hole portions per unit area of a surface of the acoustic liner facing the inside of the exit flow channel becomes smaller toward a downstream side of the exit flow channel.

10. A compressor comprising:
a rotation shaft which rotates around an axis;
an impeller which press-feeds a fluid from one side in an axial direction toward an outward side in a radial direction by rotating together with the rotation shaft;
a casing which surrounds the rotation shaft and the impeller and in which an exit flow channel for introducing the fluid press-fed from the impeller is formed; and
an acoustic liner which is provided so as to face an inside of the exit flow channel in the casing, wherein
the acoustic liner has:
a plurality of open hole portions which are arranged with intervals therebetween; and
acoustic spaces which each communicate with one or more of the open hole portions, and
each of the acoustic spaces communicates with the exit flow channel only through the open hole portions that are disposed along a direction perpendicular to a direction of flow of the fluid in the exit flow channel.

11. The compressor according to claim 10, wherein the acoustic spaces communicate with each other in regions of which static pressures are equivalent to each other in the exit flow channel.

12. The compressor according to claim 11 further comprising:
a plurality of diffuser vanes which are provided in the exit flow channel, extend toward a front side of the impeller in a rotation direction from an inward side toward the outward side in the radial direction with respect to the axis, and are arranged at intervals in a circumferential direction, wherein the acoustic spaces communicate with each other in regions extending in a direction orthogonal to the diffuser vanes.

13. The compressor according to claim 11, wherein the acoustic liner further comprises regions having ring shapes centering on the axis extending in a circumferential direction and arranged in the radial direction, and adjacent ones of the acoustic spaces that are adjacent in each of the regions communicate with each other.

14. The compressor according to claim 10, wherein the acoustic liner has a first plate member in which first hole portions serving as the open hole portions are formed, and a second plate member which is stacked on the first plate member and in which second hole portions serving as the acoustic spaces are formed at positions corresponding to the open hole portions.

15. The compressor according to claim 11, wherein the acoustic liner has a first plate member in which first hole portions serving as the open hole portions are formed, and a second plate member which is stacked on the first plate member and in which second hole portions serving as the acoustic spaces are formed at positions corresponding to the open hole portions.

16. The compressor according to claim 12, wherein the acoustic liner has a first plate member in which first hole portions serving as the open hole portions are formed, and a second plate member which is stacked on the first plate member and in which second hole portions serving as the acoustic spaces are formed at positions corresponding to the open hole portions.

17. The compressor according to claim 13, wherein the acoustic liner has a first plate member in which first hole portions serving as the open hole portions are formed, and a second plate member which is stacked on the first plate member and in which second hole portions serving as the acoustic spaces are formed at positions corresponding to the open hole portions.

18. The compressor according to claim 10, wherein the open hole portions are constituted such that a number of the open hole portions per unit area of a surface of the acoustic liner facing the inside of the exit flow channel becomes smaller toward a downstream side of the exit flow channel.

* * * * *